US005318120A

United States Patent [19]

Hisaw

[11] Patent Number: 5,318,120

[45] Date of Patent: Jun. 7, 1994

[54] WELL TESTING VALVE

[75] Inventor: Jack Hisaw, Scott, La.

[73] Assignee: Specialty Machine & Supply, Inc., Scott, La.

[21] Appl. No.: 898,118

[22] Filed: Jun. 12, 1992

[51] Int. Cl.[5] ..... E21B 34/14

[52] U.S. Cl. ..... 166/250; 166/332; 166/386

[58] Field of Search ..... 166/250, 386, 332, 334

[56] References Cited

U.S. PATENT DOCUMENTS

| | | | |
|---|---|---|---|
| 4,355,685 | 10/1982 | Beck | 166/240 |
| 4,508,174 | 4/1985 | Skinner et al. | 166/373 |
| 4,583,592 | 4/1986 | Gazda et al. | 166/250 |
| 4,669,537 | 6/1987 | Rumbaugh | 166/113 |
| 4,790,378 | 12/1988 | Montgomery et al. | 166/66 |
| 4,830,107 | 5/1989 | Rumbaugh | 166/250 |
| 9,842,064 | 6/1989 | Gazda | 166/250 |

OTHER PUBLICATIONS

Petroline; Downhole Shut-in Tool date unknown.
Universal; Shelton Series JE; Well Bore Storage Eliminator; date unknown.

*Primary Examiner*—William P. Neuder
*Attorney, Agent, or Firm*—Roy, Kiesel & Tucker

[57] ABSTRACT

An apparatus and method for obtaining a pressure build-up survey from a well bore intersecting a reservoir, the well bore containing a landing receptacle, is disclosed. The apparatus comprises locking means for locking the apparatus in the landing receptacle, valve means for selectively opening and closing the well bore. Also included is prong means for selectively opening and closing the well bore, and recording means for recording the bottom hole pressure and temperature.

20 Claims, 10 Drawing Sheets

WELL TESTING VALVE

BACKGROUND OF THE INVENTION

This invention relates to a well testing valve. More particularly, but not by way of limitation, this invention relates to a down hole well testing valve used to obtain pressure build-up test data from a reservoir.

In order to obtain optimum production from a reservoir, bottom hole pressure surveys are routinely performed in order to determine pertinent reservoir characteristics. As those of ordinary skill in the art will appreciate, pressure build-up test are performed throughout the life of the reservoir, which includes immediately after discovery, and also after the reservoir has been placed on secondary or tertiary recovery. These test generally comprise of a flow period, a shut-in period, followed by other flowing, and shut-in periods.

Important data is obtained during both the flowing and build-up periods. Various test can be designed such that the duration and number of flowing and build-up periods depend on the individual characteristics of the reservoir.

Another important consideration is the location of the pressure gauge in the work string being utilized. Generally, it is most desirable to have the bottom hole pressure and temperature gauges as close to the reservoir as possible in order to alleviate problems such as well bore storage and flow-back when changing the test mode from flowing to shut-in.

A significant number of reservoirs are thousands of feet deep. Therefore, in designing a pressure test, an important feature is the location of the pressure and temperature gauges.

Various designs have been attempted in the prior art. For instance, in U.S. Pat. No. 4,583,592 to Gazda, the application discloses a well test tool for closing a well at a down hole location below the well packer and near the formation to be tested. The apparatus is openable and closeable from the surface by tensioning and then relaxing the cable. The test tool has a lock mechanism which locks automatically upon entering the landing receptacle in the well bore.

In U.S. Pat. No. 4,842,064 to Gazda, the specification discloses an apparatus including a landing receptacle for placing in a well bore, preferably near the well packer, and a well test tool lowerable with instrumentations into the tubing on a flexible line and anchorable in the landing receptacle, the test tool then being operational between open and closed positions by tensioning and relaxing the flexible line to open and close the well at the down hole location.

Another well test tool is disclosed in U.S. Pat. No. 4,830,107 to Rumbaugh. The tool includes a valve lowerable into a well on a flexible line and locked and sealed in a down hole landing receptacle, the valve being openable and closable to permit or prevent flow therethrough, well pressures below the test tool being sensed and recorded by a recording pressure gauge both during periods of flow and during shut-in periods.

Also, attention is drawn to U.S. Pat. No. 4,669,537, wherein a test tool including a locking device installed in a landing receptacle, and a sleeve valve with a recording instrument attached thereto is claimed . Therefore, there are numerous designs which have been attempted with regard to attaching a down hole valve to a landing receptacle, and pressure testing the intersecting reservoir. However, the prior art designs suffer from the ability of being able to set the valve in the landing receptacle, flowing the well, and re-entering the well bore with a closing device while the well is flowing, and shutting-in the reservoir.

Therefore, an object of this invention is to provide a bottom hole pressure assembly to be landed in a landing receptacle of a well bore near a reservoir, and be able to obtain multiple flowing and shut-in pressure surveys.

SUMMARY OF THE INVENTION

The present invention contains apparatus claims for a device for pressure testing a reservoir in a well bore. The device will contain in one embodiment a tubular housing having a portion containing a port, having a portion defining a shoulder, and a lug attached to the housing. A valve member stem is slidably disposed within the housing, with the valve stem being operable between an open and a closed position. The valve stem will also have an aperture.

A mandrel, which is disposed about the valve stem, will have contained thereon a portion defining a J-slot profile. Means for biasing the valve stem against the shoulder of the housing is also provided. Also included is an activation means for depressing the valve stem, which in turn causes the J-slot profile to travel about the lug.

The valve stem may contain a blind bore and equalizing means disposed in the bore for equalizing pressure above and below the housing in the well bore. The equalizing means includes a cylindrical valve member disposed within a cavity member of the valve member stem, and communication means for communicating pressure from the well bore of the housing with a chamber located in the cavity. Also included is a second biasing means for biasing the cylindrical valve stem in a closed position.

In one embodiment of the invention, the activation means will be a prong member run into the well bore on wire line from a surface location. The apparatus will also contain pressure and temperature means for determining the pressure and temperature of the reservoir.

The invention also contains a method of pressure testing a reservoir intersected by a well bore, which comprises positioning a bottom hole assembly in the well bore. The assembly includes lock mandrel means, a tubular housing, a valve stem, a mandrel disposed about the stem and having a portion containing a J-slot profile for guiding a lug, activation means for operably switching the valve from an open position to a closed position, and equalizing means for equalizing pressure above and below the housing in the well bore. Recording means are also provided for recording the well bore temperature and pressure.

The method comprises the steps of locking the assembly in a landing receptacle with the valve stem open, flowing the reservoir, recording the pressure and temperature of the reservoir, positioning a prong in the well bore to cause said activation means to position said valve in the closed position; and exiting the well bore with the prong.

The method may further comprise the steps of recording the shut-in pressure and temperature in the well bore, positioning in the well bore the prong, depressing the activation means to shift the valve stem in the open position, exiting the well bore with the prong, and flowing the reservoir again. This procedure may be repeated until a complete pressure survey has been performed.

Afterwards, a pulling tool is positioned in the well bore, and the assembly is retrieved.

A feature of the present invention is the use of a J-slot profile in order to shift a valve member from an open position to a closed position. Another feature of the present invention includes an inner mandrel which will have defined thereon the profile. Another feature of the present invention includes the use of a spring biasing means for biasing the mandrel in either its open or closed positioned, depending on the location of the lug in the profile.

Yet another feature of the invention consist of a fluted prong which will allow the shifting of the valve stem, thereby closing or opening the work string to flow from the reservoir. Still another feature includes an equalizing valve that will equalize the pressure above and below the assembly in the work string after a shut-in period has been completed.

An advantage of the present invention is the ability to obtain a pressure test, both flowing and shut-in, without the necessity of leaving a work string, such as wire line or coiled tubing, in the well bore. Another advantage is that at the surface, the well is continually left open, and is not shut-in. Another advantage is that the prong can be run into the well when the well is flowing.

Still another advantage includes being able to adapt the bottom hole assembly to be positioned within any type of landing receptacle that is structurally in place in the work string. Another advantage is that the bottom hole assembly can be run on any type of locking mandrel, and locked into the landing receptacle.

DESCRIPTION OF THE PREFERRED EMBODIMENTS

Figure 1:
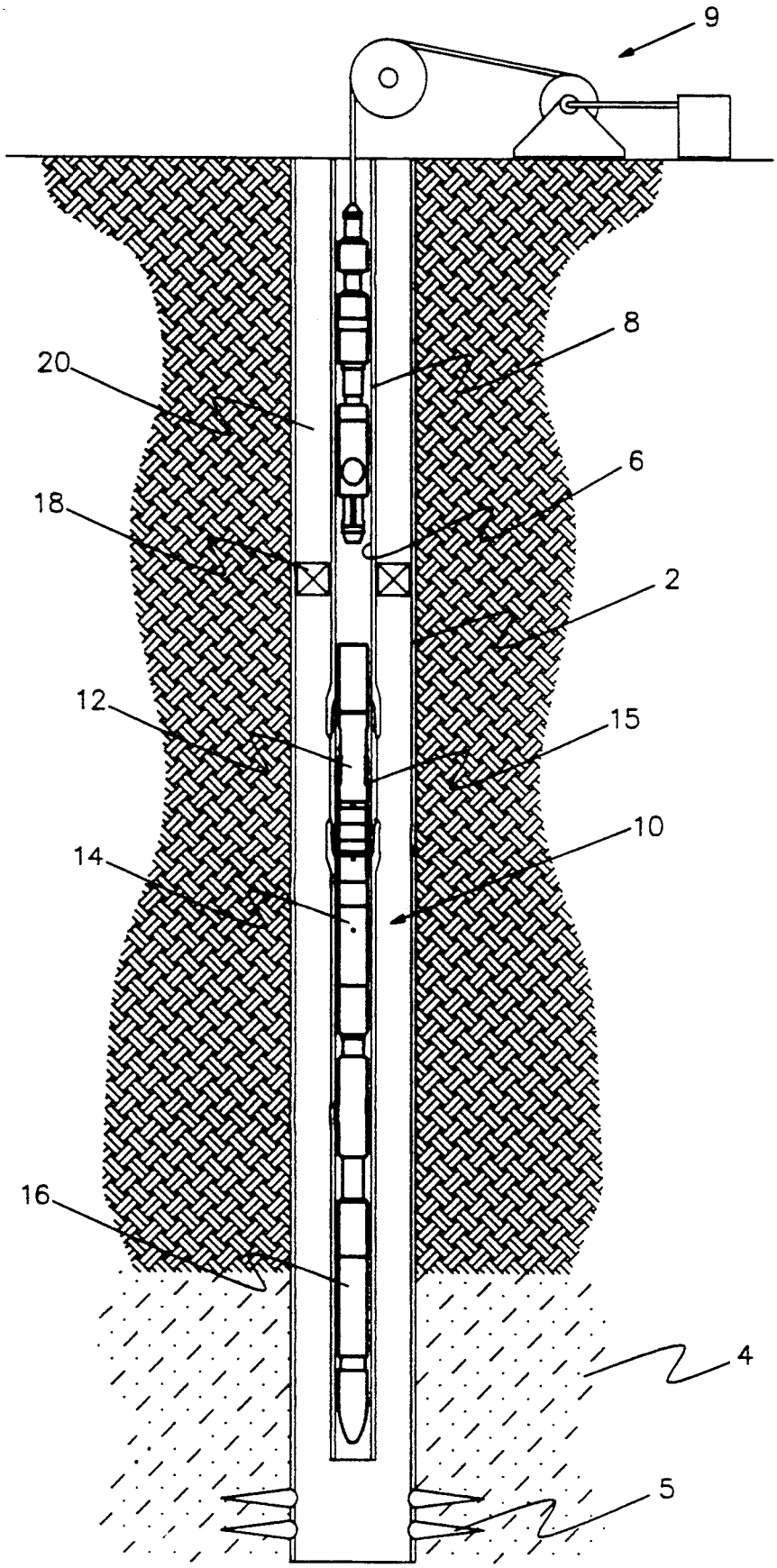
FIG. 1 is a schematic view of a well bore intersecting a reservoir, with the well bore containing a work string and one embodiment of the present invention.

Referring to FIG. 1, a schematic view of a well bore 2 intersecting a reservoir 4 is depicted. In the preferred embodiment, the reservoir 4 will be hydrocarbon bearing, and will contain perforations 5 which will communicate the reservoir with the internal diameter 6 of the work string 8. A representative wire line unit is shown at 9.

The work string 8 will generally be a tubing string. However, it should be understood that the invention will be operative with other work strings such as drill pipe. The work string will be connected to surface facilities (not shown) for the production and separation of oil, gas and water from the reservoir 4.

The down hole tool of the present invention is shown generally at 10. The tool 10 will comprise of a locking device 12, the down hole valve 14, and the pressure and temperature means 16 for reading and recording the pressure and temperature of the reservoir. The locking device is positioned within a landing receptacle 15, with the landing receptacle being threadly attached to the work string 8.

A packer means 18 is also depicted wherein the packer is positioned within the well bore so that the annulus area 20 is sealed from the pressure of the perforations 5. Therefore, flow from the reservoir 4 progresses from the perforations 5, through the down hole tool 4 (when the valve 14 is opened), and through the internal diameter 6 of the work string 8 to the surface facilities.

Figure 2A:
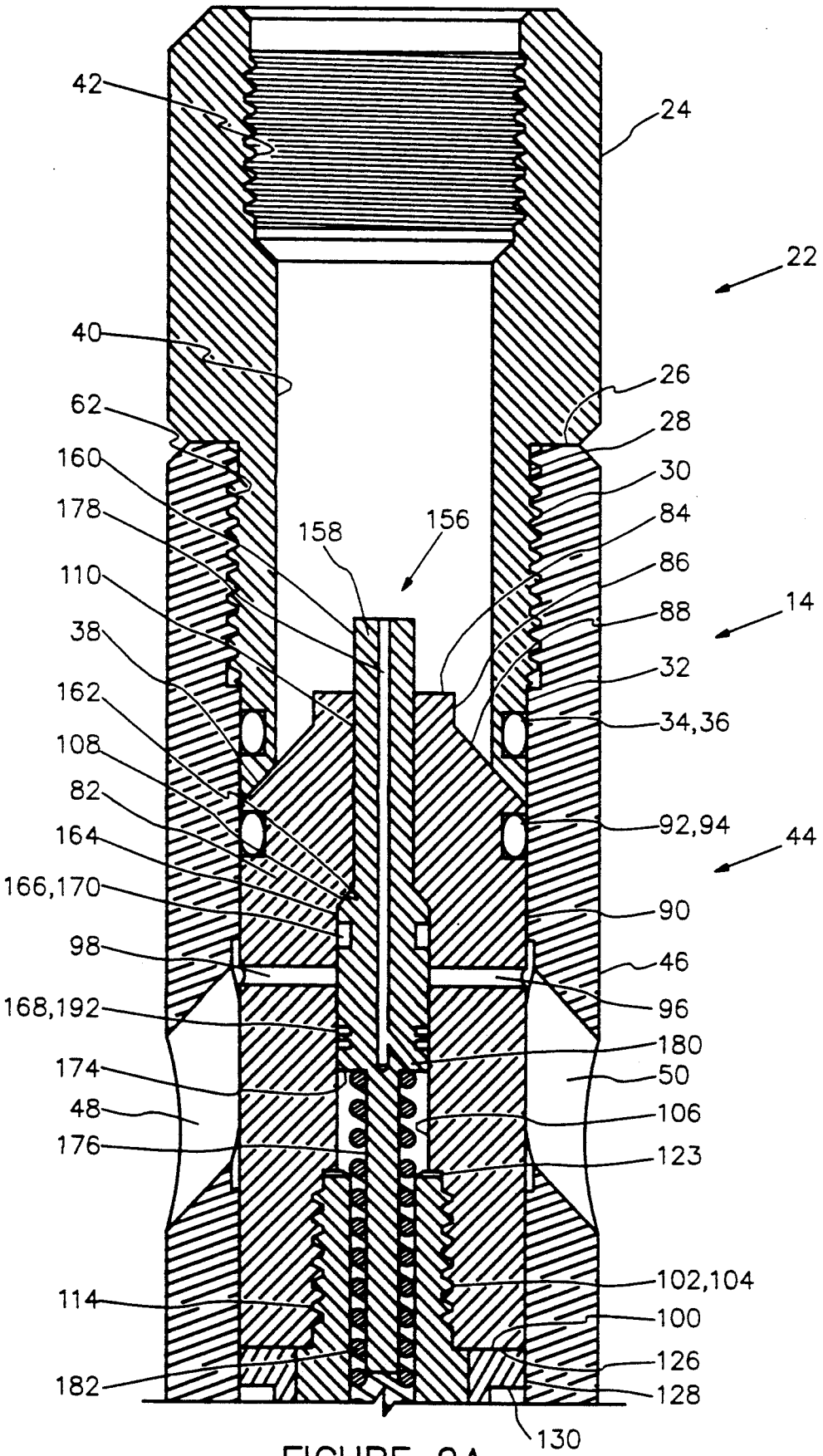
FIG. 2A, 2B, and 2C are schematic partial cross-sections of the present invention in the closed position.

Referring to FIG. 2A, the down hole valve 14 will now be described. The valve 14 comprises an upper tubular housing 22 which includes a first cylindrical surface 24 which extends to a shoulder 26 which terminates at a second cylindrical surface 28, with the surface having thereon external thread means 30. The thread means 30 will terminate at smooth bore 32 and have defined thereon groove 34 for placement of sealing means 36.

Extending radially inward is chamfered shoulder 38, with chamfered shoulder 38 terminating at cylindrical bore 40. The bore 40 extends until the internal thread means at 42.

Figure 2B:
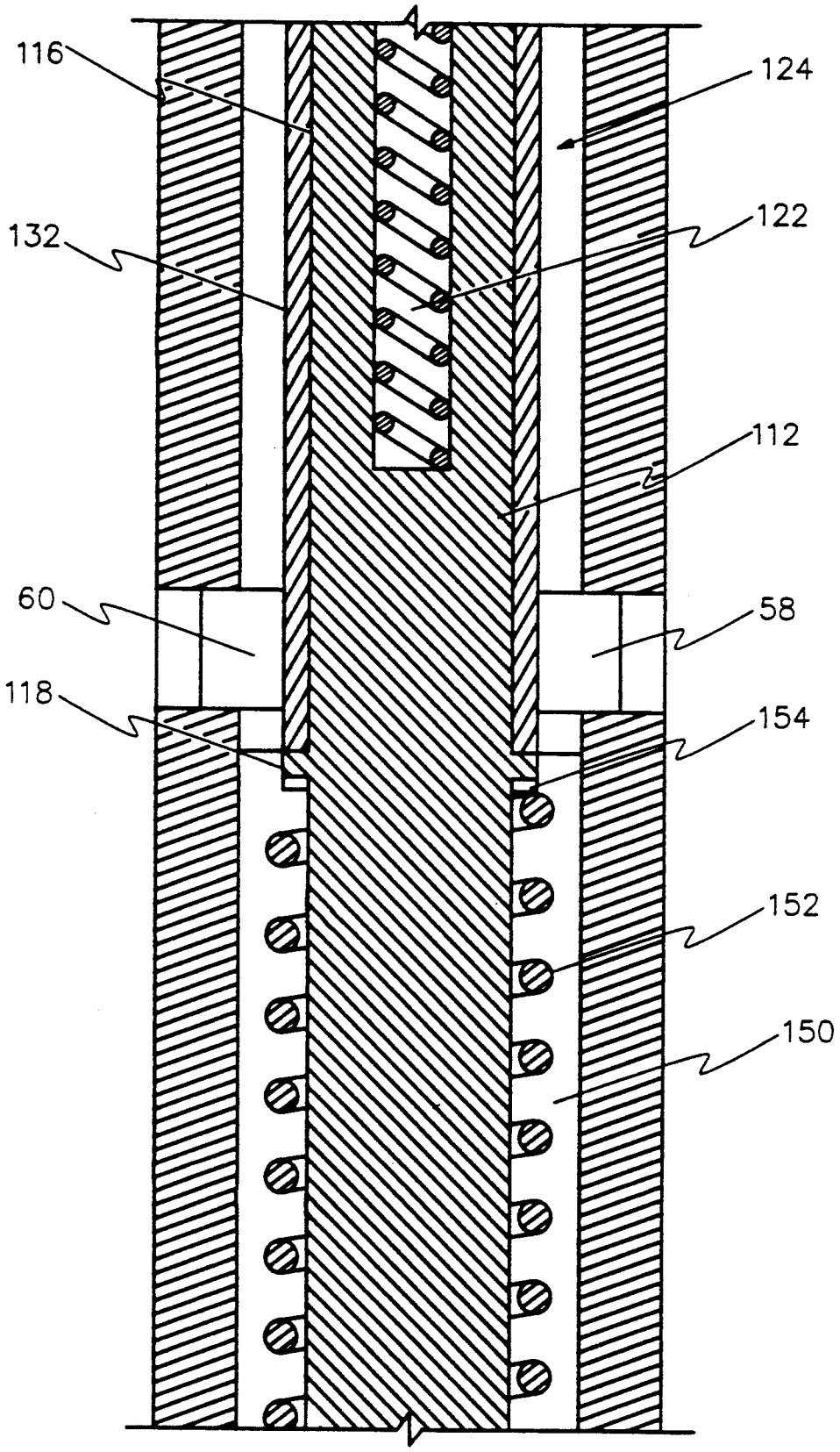
Figure 2C:
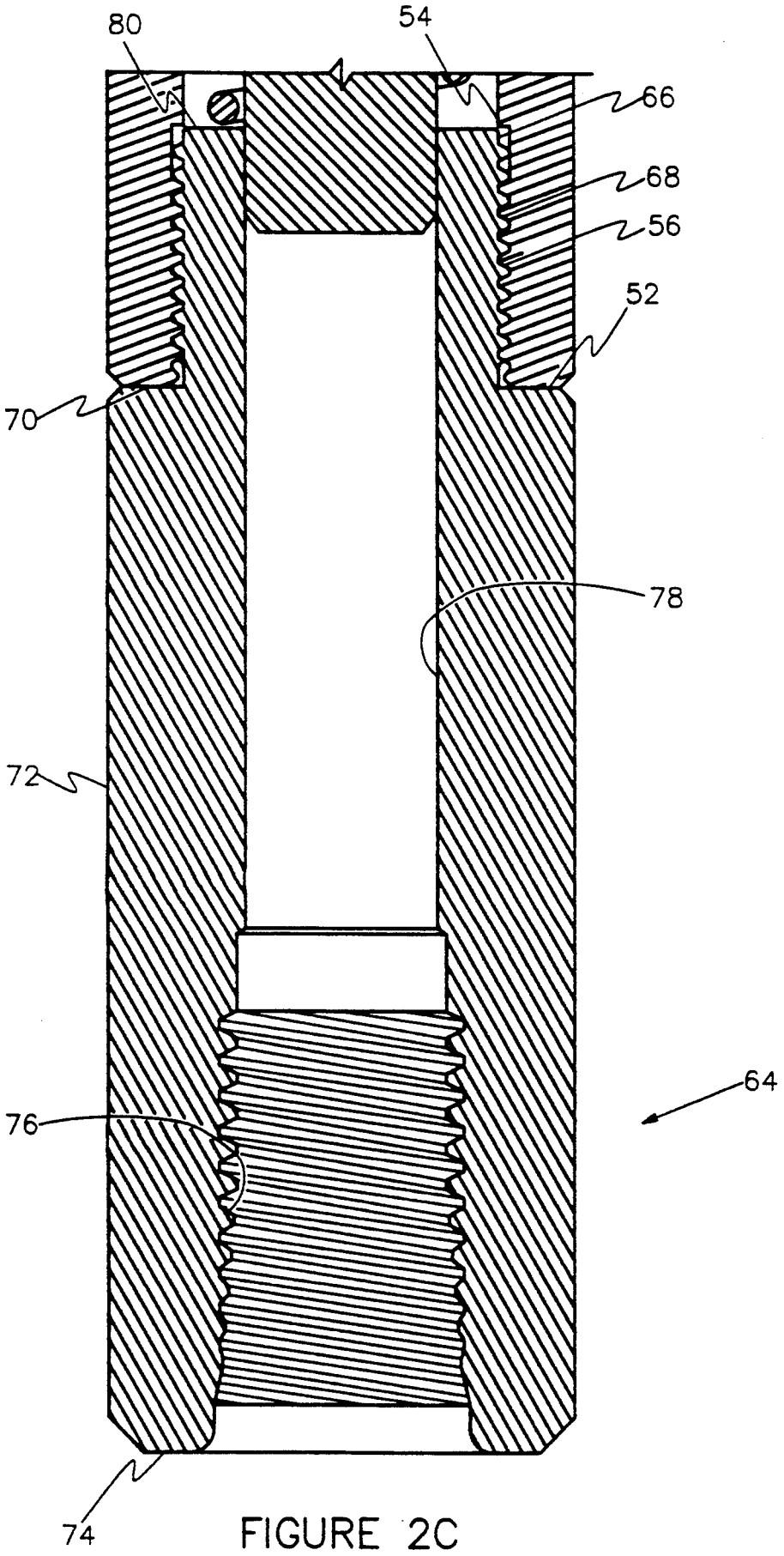

The intermediate tubular housing, seen generally at 44, includes a first cylindrical surface 46 which contains a plurality of ports 48, 50 extending therethrough, the surface 46 terminating at the shoulder 52-see FIG. 2C. Extending radially inward is internal diameter 54 which will contain internal threads 56 thereon. Referring to FIG. 2B, lugs 58, 60 are fixed on the internal diameter, such as by spot welding. The internal diameter 54 concludes at internal threads 62.

Turning now to FIG. 2*c*, the lower tubular housing, seen generally at 64, comprises a first cylindrical surface 66 which contains external thread means 68, with the surface 66 concluding at shoulder 70. A second cylindrical surface 72 extends therefrom and terminates at shoulder 74. Extending radially inward is internal thread means 76, which in turn leads to cylindrical bore 78, with the bore 78 concluding at shoulder 80.

The valve means, seen in FIG. 2A, of the present invention will now be described. The valve means comprises of an upper valve stem 82, also referred to as a piston, which is slidably received within the internal diameter 54 of the upper tubular housing. The valve stem 82 comprises a first radially flat surface 84 that extends to a first cylindrical surface 86, which in turn extends to an angled surface 88, which terminates at the second cylindrical surface 90.

The second cylindrical surface 90 will have disposed thereon a plurality of recess means 92 for placement of seal means 94, as well as a plurality of passage way means 96, 98. Note, that in the figure depicted that the chamfered shoulder 38 and the angled surface 88 of the stem 82 are in a metal-to-metal contact which results in a metal-to-metal seal.

The second cylindrical surface 90 terminates at the shoulder 100, with the shoulder extending to an internal cavity 102, which comprises internal thread means 104, a first internal bore 106, a chamfered shoulder 108, and a second internal bore 110.

Referring to FIG. 2A and 2B, the lower valve stem 112 will generally comprise an external thread means 114, which is threadedly attached to the internal thread means 104. The thread means 114 extends to the first cylindrical surface 116, which in turn terminates at border surface 118, which in turn extends to the second cylindrical surface 120. Valve stem 112 will have defined therein a cavity 122, which is essentially aligned with the internal bore 106, and further contains sealing means 123.

The operating mandrel is shown generally at 124 and will generally comprise a radially flat surface 126 which extends to cylindrical surface 128, which in turn concludes at shoulder 130. Second cylindrical surface 132 extends therefrom and continues to terminating shoulder 134, which will abut the border surface 118.

Figure 3:
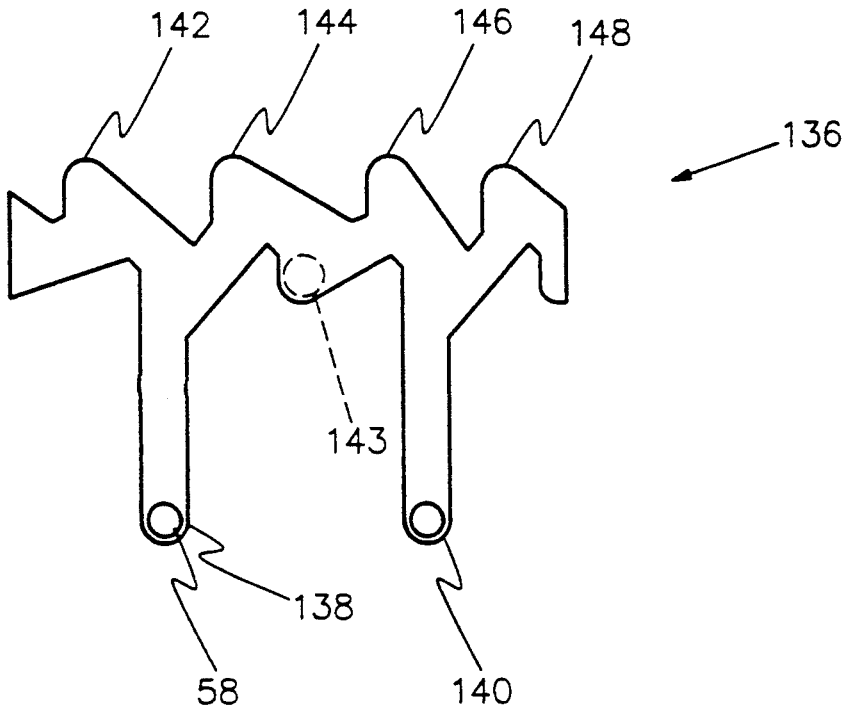
FIG. 3 is an unwrapped profile of the mandrel of the present invention.

Referring to FIG. 3, the mandrel 124 will have defined thereon a recessed track 136, which is a grooved pattern which cooperates with and guides the travel of the mandrel 124 about the lugs 58, 60, which is also known as a J-slot profile. The profile has two elongated legs 138, 140, and four shortened legs 142, 144, 146, 148 which serve to guide the relative movement of the mandrel 124 a the track travels about the lugs 58, 60.

Referring again to FIG. 2B, the intermediate tubular housing 44, and the second cylindrical surface 120 of the valve stem 112 form a chamber 150, which will have disposed therein a biasing means 152, such as a conical spring. Also, a cylindrical washer 154 is disposed about the valve stem 112. The purpose of this washer is to keep the spring from rotating within the chamber.

Referring again to FIG. 2A, the equalizing means, seen generally at 156, for balancing the pressure within the work string when the valve means is closed will now be described. The equalizing means 156 is comprised of a equalizing shaft or stem 158 which has a first cylindrical surface 160 that extends to a chamfered shoulder 162, which in turn continues to a second cylindrical surface 164, with second cylindrical surface 164 having a plurality of recesses 166, 168 that will contain sealing means 170, 172.

The cylindrical surface 164 terminates at radial shoulder 174, With the radial shoulder extending to the third cylindrical surface 176. The equalizing valve stem 156 will have delineated therein communication means which will be in the preferred embodiment a first longitudinal bore 178 and a second oblique bore 180, with the second oblique bore being in communication with the cavity 122.

The second biasing means 182, which in the preferred embodiment is a conical spring, is disposed within the cavity 122 and about the valve stem third cylindrical surface 176 such that the spring urges against the shoulder 174. Further, the surfaces 162 and 108 are urged against one another by the spring force.

Figure 4:
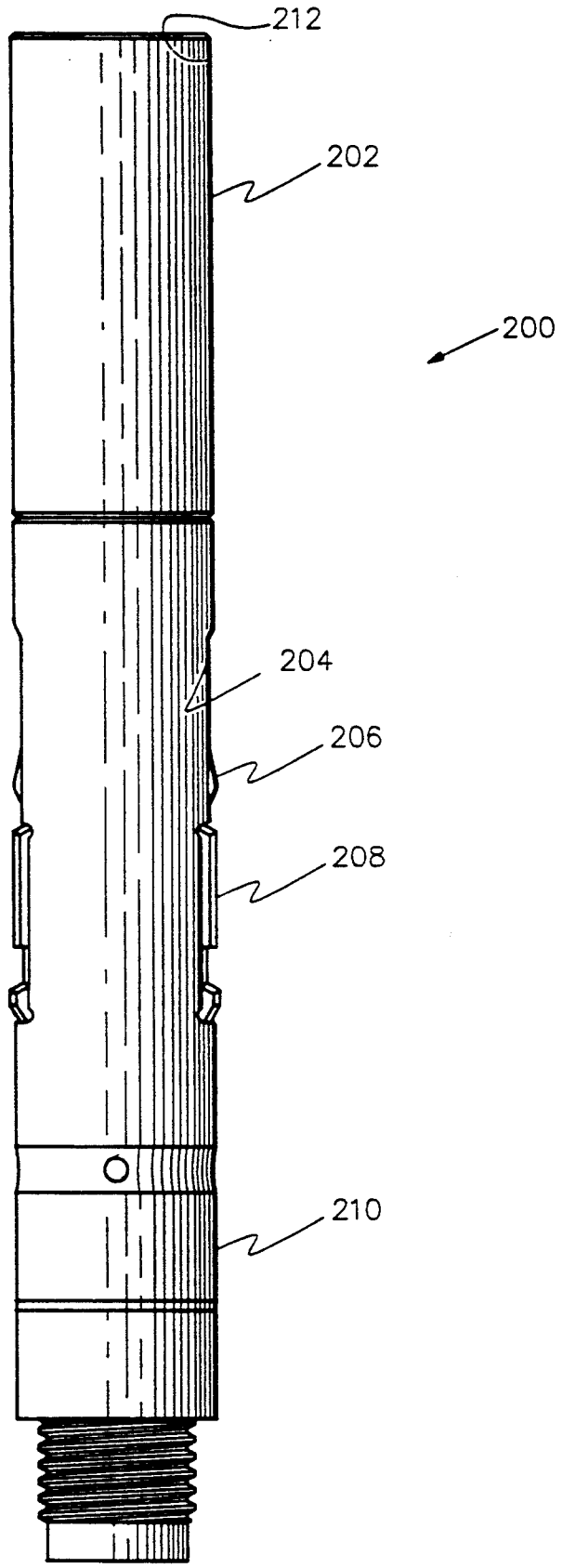
FIG. 4 is a schematic view of a typical locating mandrel means which may be employed with the present invention.

Referring now to FIG. 4, a typical lock device 200 is shown, which is equivalent to the locking device 12 shown in FIG. 1. It should be understood that different types of locking devices can be employed. The purpose of a locking device is to locate in the landing receptacle (which is attached and made a part of the work string), and then have the locking device remain attached in the landing receptacle. In the industry, there are different types of locking devices, and the embodiments of the present invention can easily be adapted to be operative with them.

For example, an "X" locking device is depicted in FIG. 4; the term "X" locking device is a trademark of Otis. However, locking devices such as a Baker "F" or "R" or a Camco "M" or "C" could be used. The actual locking device chosen simply depends on the type of landing device which is in the well, and other well design characteristics such as work string size.

The locking device 200 will generally comprise of a cylindrical body 202 having openings 204 that will have key springs 206 and keys 208 disposed therethrough. The body 202 will also have seal means 210, which in the preferred embodiment will be packing elements, for creating a seal in the seal bore of the landing receptacle 15. Extending radially inward will be the fishing neck 212 which allows for retrieval of the locking device 200.

Figure 5:
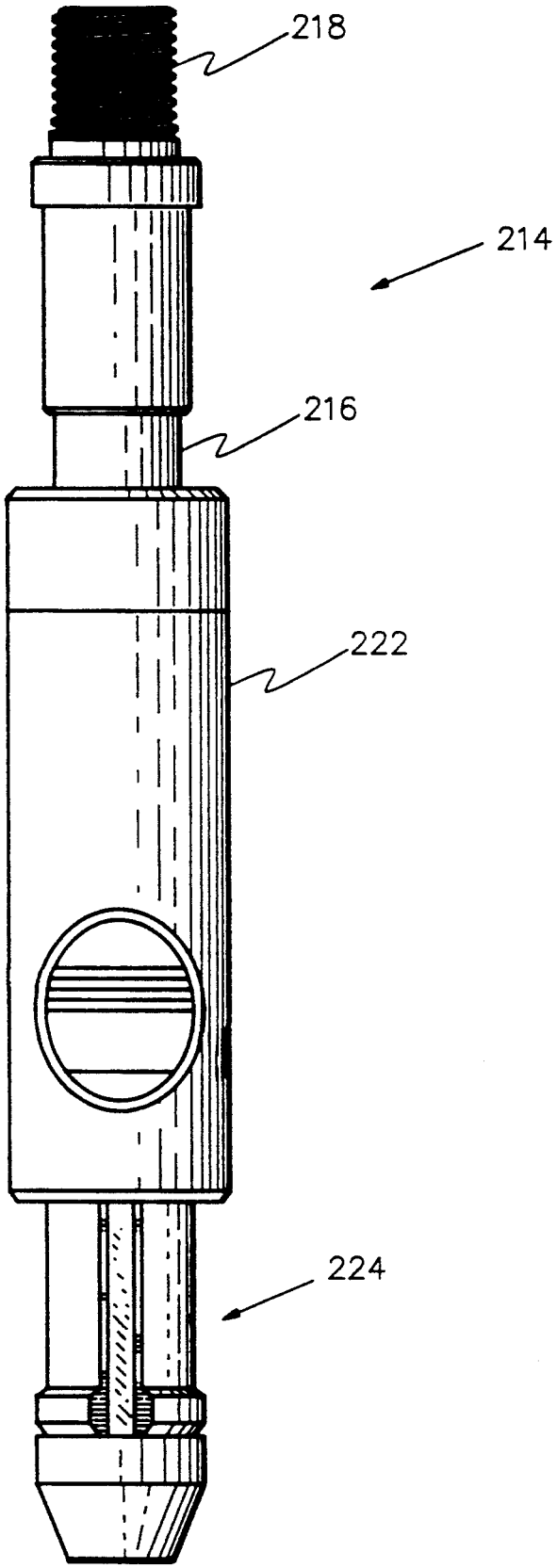
FIG. 5 is a schematic view of a typical pulling tool means which may be employed with the present invention.

Referring to FIG. 5, a typical device which is used to retrieve the locking device 200 is a pulling tool 214. As is the case with the locking tool, there are different types available in the industry, such as the "R", "S" or "JDC". The pulling tool may comprise an inner core barrel 216, with the barrel 216 having a fishing neck 218 disposed on one end, and a prong end 220 disposed on the other. The pulling tool will also have an outer mandrel 222 disposed about the inner core barrel 216, and disposed between the mandrel 222 and the core 216 are dogs 224, which are utilized to collapse the keys 208 of the locking device.

Figure 6:
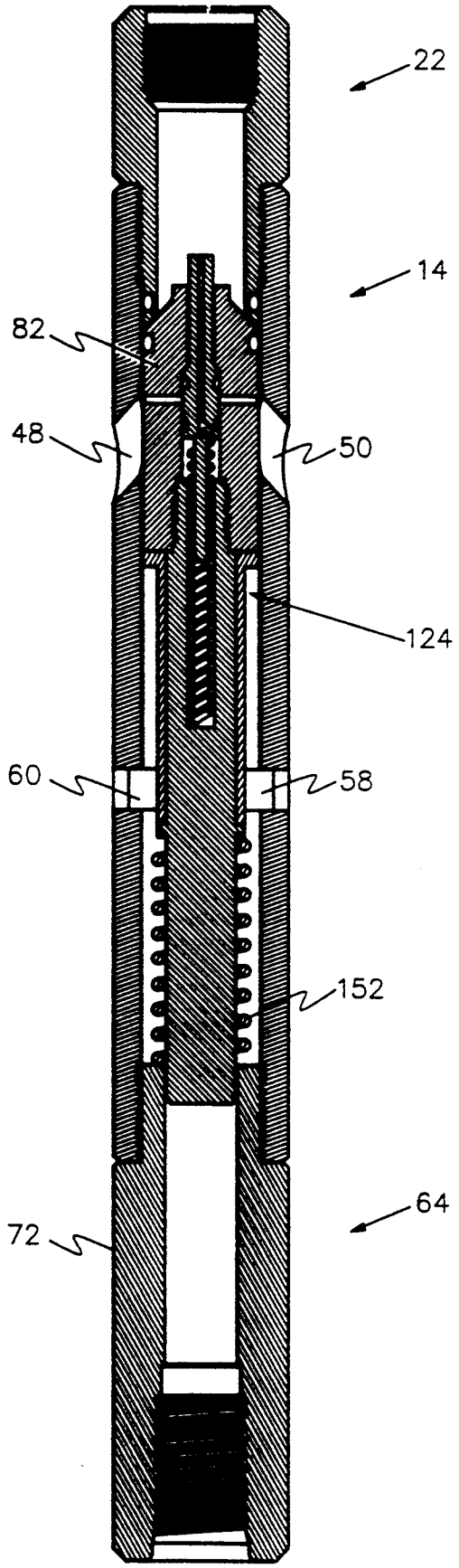
FIG. 6A is a schematic view of the prong means and 6B is a cross-sectional of the prong means of the present invention.
Figure 6A:
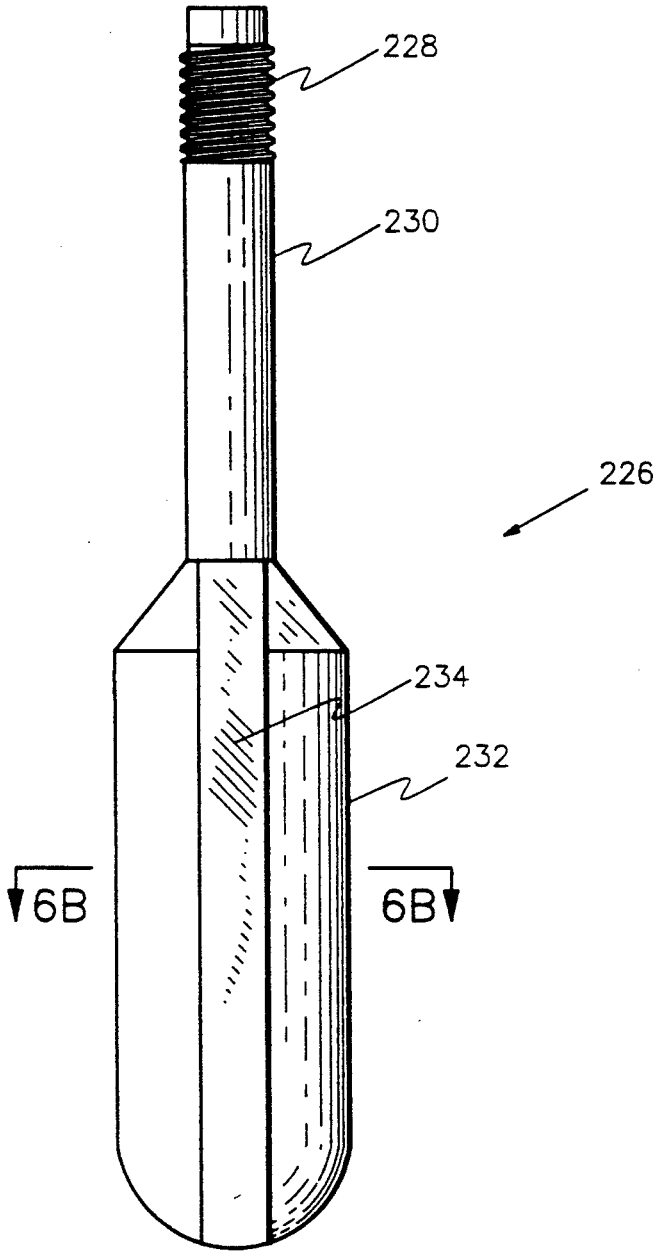
Figure 6B:
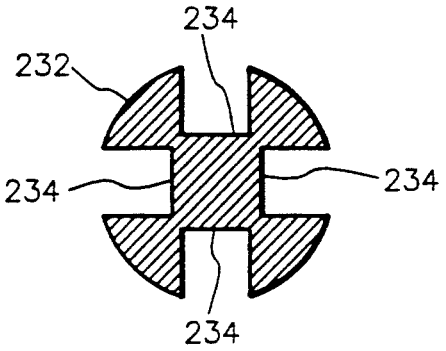

FIG. 6 depicts a fluted prong 226 which will be used to depress the valve stem 82, as well as equalizing means 156. The fluted prong will have a first end which will contain thread means 228, a cylindrical body 230 which may be tapered such that the thickness increases towards the second end 232, indentations 234 formed along the body 230, in a generally longitudinal direction. The indentations are formed for the passage of reservoir fluids and gases during the production phase of the survey-see cross-sectional taken along line A—A, FIG. 6B.

Figure 7:
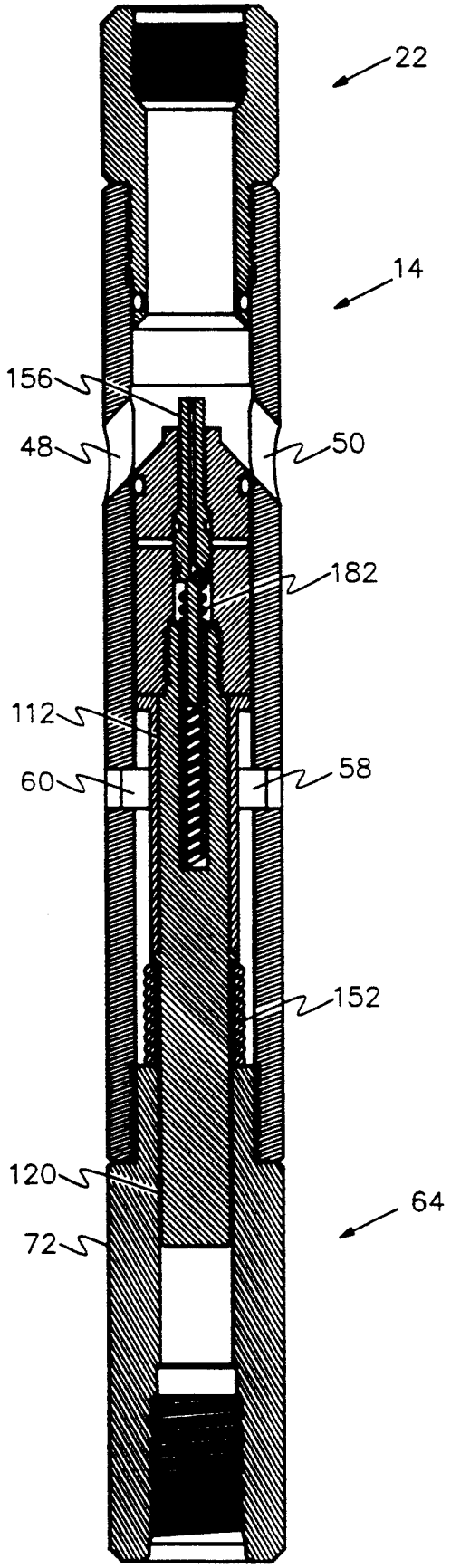
FIG. 7 is a schematic partial cross-section of the present invention in the open position.

FIG. 7 shows the valve in the open position. Like numbers refer to like elements previously described.

OPERATION

The operation of the down hole shut-in tool will now be discussed. The bottom hole assembly will generally be run into the well bore 2 on wire line. It should be appreciated that the bottom hole assembly can also be run on either electric line, or coiled tubing, depending on the choice of the operator.

The down hole tool 10 will be run into the well bore 2 with the valve stem 82 in the open position as depicted in FIG. 7. The tool 10 will be secured to the locking device 200, and will be run past the landing receptacle 15. At this point, the keys 208 will contract, or collapse, as the locking device is run through the landing receptacle 15; this process is known as locating the locking device in the receptacle 15.

Next, the locking device is positioned in the receptacle such that the keys 208 will anchor the assembly to the landing receptacle 15. Further, the seal means 210 will be engaged in the seal bore of the landing receptacle 15.

The well bore, at the surface, can then be opened to flow to the production facilities, and a flowing survey can then be established, with the pressure means 16 recording the flowing bottom hole pressure. Once it is determined that a sufficient flowing period has been completed, the operator will run in the well bore 2 with the fluted prong 226 (note that the reservoir is still flowing), and set down on the valve stem 84, which in turn will cause the lugs 58 and 60 to travel longitudinally upward within the recessed track 136 to the position seen as 148 in FIG. 3.

Once the predetermined weight has been set down on the stem 84, the lug will shoulder the mandrel 124 at the position shown at 148. The fluted prong is then run out of the well bore 2. This will cause the biasing means to urge the operating mandrel 124 upward, thereby causing the lug to be in the elongated leg position shown as 140. At this position, the valve stem will be in the position shown in FIG. 2A, which will effectively close the well bore to flow, and thus, a pressure build-up can then commence, with the pressure means recording the down hole pressure.

Once the operator determines that a sufficient build-up pressure has been obtained, the fluted prong 226 is again run into the well bore 2, and the valve stem 84 is again depressed in order to open passageways 58. At this point it will be necessary to equalize the pressure above and below the bottom hole assembly. Thus, by lowering the prong 226, the equalizing means 156, and in particular the equalizing shaft 158, will be depressed such that the chamfered surface 162 will be unseated from the chamfered shoulder of the valve 14. Once the seals means 170 and 172 drop below the passageway means 96 and 98, the pressure from the reservoir 4 will be able to equalize with the area within the work string 8 above the tool 10, thereby equalizing the pressure.

It should also be noted that the cavity 122 may contain trapped pressure. Therefore, the equalizing procedure described above will act to vent the pressure in the cavity as follows: the shaft 158 is depressed by the fluted prong, the oblique bore 180, which is in communication with the longitudinal bore 178, will travel past seal means 123, thereby allowing communication with the cavity 122 and the work string 8. After the fluted prong is lifted from the well bore 2, the biasing means 182 will act to urge the equalizing shaft 158 up, and create a metal-to-metal seal between chamfered surface 162 and shoulder 38.

Thus, by continued lowering of the prong 226, the lug will abut the shoulder 144, as seen in FIG. 3. Next, the prong is pulled out of the well bore 2, and the biasing means 152 will then cause the mandrel 124 to move longitudinally upward, thereby positioning the lug 58 at the shoulder 138, which will in effect allow the valve stem 82 to move to its closed position, as shown in FIG. 2A.

At this point, another build-up period can be established. After the requisite time period, the well can be opened up again to flow from the reservoir utilizing the procedure outlined above. After the well has been placed on production, the procedures to shut-in and obtain another build-up can be utilized.

Alternatively, the entire down hole tool can be pulled out of the hole. Thus, the operator would position the pulling tool 214 in the well bore 2. The core 216 which contains the collapsing dogs 224 will enter the inter diameter of the lock device 200. As will be appreciated by those of ordinary skill in the art, the dogs 224 will collapse the keys 208, and further engage the fishing neck of the lock device 200 which will allow for the removal of the down hole tool from the well bore.

An equalizing sub (not shown) can also be run on the bottom hole assembly in order to equalize the pressure above and below the down hole tool. The equalizing sub is in addition to the previously described equalizing means 156. Equalizing subs are common in the industry, such as the "X", "B", "H" or "A.3."

Once retrieved to the surface, the pressure means can be read by surface computer means, and determined whether any further pressure transient test are required.

Changes and modifications in the specifically described embodiments can be carried out without departing from the scope of the invention which is intended to be limited only by the scope of the appended claims.

I claim:

1. An apparatus for testing a reservoir, comprising:

a tubular housing having a portion containing a port and having a shoulder defined therein, and a lug attached to said housing;

a valve stem slidably disposed within said tubular housing, said valve member stem being operable between an open and closed position, said valve member stem having an aperture;

a mandrel, disposed about said valve member stem, having a portion containing a j-slot profile;

first biasing means, disposed about said valve member stem, for biasing said valve stem against said shoulder;

activation means for depressing said valve member stem and causing said j-slot profile to travel about said lug.

2. The apparatus of claim 1, wherein said valve stem has defined therethrough a cavity, and the apparatus further comprises:

equalizing means, disposed within said valve stem cavity, for equalizing pressure.

3. The apparatus of claim 2, further comprising:

pressure and temperature recording means threadedly attached to said tubular housing for recording the reservoir's pressure and temperature.

4. The apparatus of claim 2, wherein said equalizing means includes:

an equalizing shaft disposed within said cavity member, said shaft having a first portion and a second portion, with said second portion and said cavity member forming a chamber;

communication means, disposed through said shaft, for communicating pressure from the bore of said tubular housing and said chamber;

second biasing means, disposed about the second portion of said shaft and located within said chamber, for biasing said shaft in a closed position.

5. The apparatus of claim 2, wherein said activation means comprises a prong cylindrical member run in the well bore on wire line.

6. The apparatus of claim 5, wherein said prong contains groove means for the passage of a flowing medium during a flow period.

7. The apparatus of claim 6, further comprising:

pressure reading means, threadedly attached to said tubular housing, for reading the pressure within said well bore.

8. A method of pressure testing a reservoir intersected by a well bore containing a landing receptacle, said method comprising the steps of:

a. running in the hole with a bottom hole assembly, said bottom hole assembly including: lock mandrel means, a tubular housing, a valve member stem slidably disposed within the housing, a mandrel disposed about said stem and having a portion containing j-slot means for guiding said lug, activation means for operably switching said valve from an open position to a closed position, and equalizing means for equalizing pressure above and below the housing, and recording means to record the pressure within the well bore;

b. locking said bottom hole assembly in the landing receptacle with said valve being in the open position;

c. flowing the reservoir;

d. recording the pressure in the well bore;

e. positioning in the well bore with a prong to cause said activation means to position said valve in the closed position.

f. exiting the well bore with the prong.

9. The method of claim 8, further comprising the steps of:

g. recording the pressure in the well bore;

h. positioning in the well bore with the prong;

i. depressing the activation means to shift said valve member stem in the open position;

j. exiting the well bore with the prong;

k. flowing the reservoir.

10. The method of claim 9, further comprising the steps of:

k. repeating steps c - k until a complete pressure survey has been performed.

11. The method of claim 8, further comprising the steps of:

g. recording the pressure in the well bore;

h. positioning in the well bore with a pulling tool;

i. retrieving the bottom hole assembly from the well bore with the pulling tool.

12. A device for obtaining a pressure build-up survey from a well bore intersecting a reservoir, the well bore containing a landing receptacle with a seal bore, the device comprising:

locking means for locking the device in the landing receptacle, the locking means containing a set of seals positioned within the seal bore of the landing receptacle;

equalizing means, threadedly attached to said locking means, for equalizing the pressure above and below the locking device;

valve means, threadedly attached to the equalizing means, for selectively opening and closing the well bore;

prong means, for selectively opening and closing said valve means; and recording means, threadedly attached to the valve means, for recording the bottom hole pressure.

13. The device of claim 12, wherein said valve means comprises:

a cylindrical housing having a portion containing a port and a lug and a shoulder;

a piston having a portion defining an aperture, said piston being slidably disposed within said cylindrical housing, said piston being operable between an open and closed position;

an operating mandrel disposed about said piston, said operating mandrel having a portion defining a recessed track;

first biasing means, disposed about said piston, for biasing said piston against the shoulder of the cylindrical housing;

shifting means for shifting said piston from a first position to a second position, so that the lug travels in the recessed track.

14. The device of claim 13, wherein said piston has defined therethrough a bore, and the device further comprises:

equalizing means, disposed within said piston bore, for equalizing pressure above and below the lock means.

15. The device of claim 14, wherein said equalizing means contains:

a cylindrical valve stem disposed within said cylindrical cavity member, said valve stem having a first portion and a second portion, with said second portion and said cavity member forming a chamber;

communication means, disposed through said cylindrical valve stem, for communicating pressure from the bore of said tubular housing and said chamber;

second biasing means, disposed about the second portion of said valve stem and located within said chamber, for biasing said valve stem in a closed position.

16. A device for pressure testing a hydrocarbon reservoir in a well bore containing a landing receptacle comprising:

landing means for landing the device within said landing receptacle;

a cylindrical member having a port and a lug and a shoulder defined therein, said cylindrical member being securely attached to said landing means;

valve means for opening and closing the well bore to a pressure from the hydrocarbon reservoir;

shifting means for shifting said valve means from an open position to a closed position.

17. The device of claim 15, wherein said valve means comprises:

a valve stem received within said cylindrical member, said stem having a front face, and an aperture therethrough;

a selectively positioning means for selectively positioning the valve stem;

spring means for biasing the front face of said valve stem into the shoulder of said cylindrical member.

18. The device of claim 16, wherein the positioning means includes:

an inner mandrel slidably disposed about said valve stem, said inner mandrel containing a groove pattern and cooperating with said lug.

19. The device of claim 18, wherein the groove pattern has a elongated leg and a shortened leg, and wherein the elongated leg corresponds to the closed positioned of said valve, and the shortened leg corresponds to the open position of said valve.

20. The device of claim 19, further comprising:

wire line means for positioning said shifting means in the well bore adjacent said landing means, and wherein said shifting means comprises an elongated prong.

* * * * *